US008287318B1

(12) United States Patent
Walters et al.

(10) Patent No.: US 8,287,318 B1
(45) Date of Patent: Oct. 16, 2012

(54) ELECTRICAL CONNECTOR WITH SPRING FOR MISSILE LAUNCH RAIL

(75) Inventors: James C. Walters, Cresson, TX (US); Brent W. Williams, Fort Worth, TX (US); Richard M. Anthony, Fort Worth, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 152 days.

(21) Appl. No.: 12/941,076

(22) Filed: Nov. 7, 2010

Related U.S. Application Data

(60) Provisional application No. 61/373,027, filed on Aug. 12, 2010.

(51) Int. Cl.
*H01R 13/24* (2006.01)

(52) U.S. Cl. ..... 439/700

(58) Field of Classification Search ..... 439/700, 439/482, 824
See application file for complete search history.

(56) References Cited

U.S. PATENT DOCUMENTS

| | | | | |
|---|---|---|---|---|
| 2,331,409 | A * | 10/1943 | Markey | 439/320 |
| 2,987,691 | A * | 6/1961 | Ross | 439/294 |
| 3,724,322 | A | 4/1973 | Reed | |
| 3,883,209 | A | 5/1975 | Kongelbeck | |
| 4,037,821 | A | 7/1977 | Greene | |
| 4,138,181 | A | 2/1979 | Hacker et al. | |
| 4,711,151 | A | 12/1987 | Griffin et al. | |
| 4,750,890 | A | 6/1988 | Dube et al. | |
| 5,414,347 | A | 5/1995 | Monk et al. | |
| 5,614,896 | A | 3/1997 | Monk et al. | |
| 6,941,850 | B1 | 9/2005 | McMahon | |
| 7,931,486 | B1 * | 4/2011 | Walters | 439/320 |
| 8,043,126 | B2 * | 10/2011 | Bjorklund et al. | 439/700 |

* cited by examiner

*Primary Examiner* — Phuong Dinh
(74) *Attorney, Agent, or Firm* — Morani Patent Law, PC

(57) ABSTRACT

An electrical connector for testing of a missile launch rail is provided. The electrical contacts of the connector move from a rear disengaged position to forward engaged positions via the energy of a compressed spring. The connector base has rail mounts for securing to a missile launch rail. A housing attaches to the base and houses a plunger, an insulator, electrical contacts, and a tube, which move forward and aft as a unit. A knob on a rear tube end enables a user to limit the initial impact of the electrical contacts on contact pins or striker points of a missile launch rail. The connector can provide electrical connection with launch rail pins as rail pins recede into the missile launch rail. Electrical contact position is governed, in part, by locating pins which ride in a track cut into an outer surface of the tube and move with rotation of an indexing ring.

14 Claims, 11 Drawing Sheets

ELECTRICAL CONNECTOR WITH SPRING FOR MISSILE LAUNCH RAIL

CROSS REFERENCE TO RELATED PATENTS

The present application claims priority under 35 U.S.C. Section 119 to U.S. Provisional Application Ser. No. 61/373,027 filed Aug. 12, 2010, which is incorporated herein by reference.

BACKGROUND OF THE INVENTION

The present invention relates generally to electrical connectors and more particularly to a connector device with a movable internal plunger and movable electrical contacts which mate with contact pins or striker points and method for using the same.

In specific applications electrical contact mating may be needed or desired at a series of linear positions along the axis of the connector using a same set of electrical contacts. While conventional connector designs may provide mating of electrical contacts at multiple linear positions, at least the initial mating contact may comprise undesirable impact upon the male contact pins and corresponding female contacts. Conventional designs may comprise a detent mechanism, which restrains the spring loaded electrical contacts of a connector in a non-contact position until the detent mechanism is released. Much like releasing the string of a cross bow, once released the movement of the electrical contacts forward is uncontrolled, governed by the stored energy. Conventional designs may yield striking forces of twelve to eighteen pounds upon detent release. Conventional detent mechanisms can be difficult to manually release, requiring significant and ergonomically challenging forces to release the mechanism.

It would be desirable to provide a method of limiting the initial contact forces, while also providing ease of use in field applications. Visual verification of electrical contact to contact pin mating may not be possible in field applications with, for example, the contact pins being recessed in a narrow opening. The amount of potential energy needed to carry the loaded electrical contacts from a disengaged position to an axially forward electrical contact position may be significant. This stored energy may conventionally yield commensurate impact forces, which are undesirable. While large stored energy forces and release of the same in conventional connectors may provide reliable forward movement of the electrical contacts under loaded field conditions, the resulting impact may compromise contact integrity and reliability with repeated application.

SUMMARY OF THE INVENTION

The present invention addresses some of the issues presented above by providing a method and a connector device for controllable displacement of a set of connector contacts via an ergonomically friendly design. Aspects of the present invention are provided for summary purposes and are not intended to be all inclusive or exclusive. Embodiments of the present invention may have any of the aspects below.

One aspect of the present invention is to enable visual assessment of the electrical contacts position relative to the connector housing from a side view of any perspective about the connector's axis.

Another aspect of the present invention is to provide a user friendly method of releasing the electrical contacts from their spring loaded disengaged position.

Another aspect of the present invention is to enable a controlled displacement of the electrical contacts from a rear non-contact position to a forward contact position.

Another aspect of the present invention is user friendly disengagement of electrical contacts from mated contact pins.

Another aspect of the present invention is a base plate comprising rail mounts for insertion in a missile launch rail.

Yet another aspect of the present invention is the recessed position of the electrical contacts within the base plate during insertion of the rail mounts in the missile launch rail and subsequent positioning of the connector along a length of the missile launch rail.

Another aspect of the present invention is the use of an indexing cylinder in combination with locating pins and tracks to regulate movement of the electrical contacts.

Another aspect of the present invention is a unit of electrical contacts, insulator, and plunger which can move from within the connector's housing and base into an opening of a missile launch rail.

Another aspect of the present invention is compatibility with conventional missile launch rails.

Another aspect of the present invention is its ease of assembly and disassembly.

Another aspect of the present invention is relative ease of use in connecting to and testing of circuitry for a missile launch rail.

Another aspect of the present invention is to provide sufficient energy to translate a plunger and electrical contacts forward into a recess of a missile launch rail using a compression spring.

Yet another aspect of the present invention is to enable control of the impact force across electrical contacts and contact pins to prolong the working life of the connector and missile launch rail without or decreasing the need for replacing the electrical contacts and contact pins.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Same reference numbers across figures refer to like elements for ease of reference. Reference numbers may also be unique to a respective figure or embodiment.

Figure 1A:
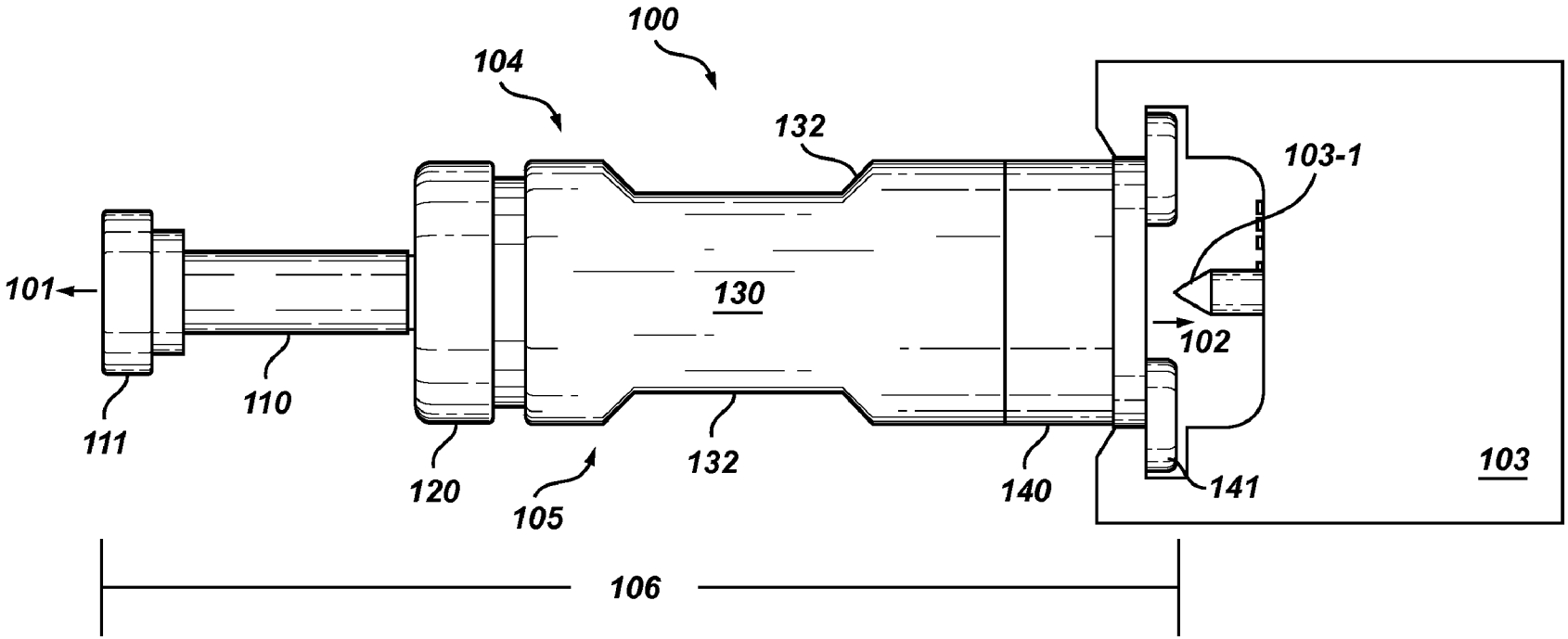
FIG. 1A shows a right side view of a connector mounted in a missile launch rail in accordance with an exemplary embodiment of the present invention.

FIG. 1A shows a right side view of a connector 100 mounted in a missile launch rail 103 in accordance with an exemplary embodiment of the present invention. A connector base 140 forms the front end 102 of the connector, which faces a contact pin, a striker point, 103-1 of the missile launch rail 103. A rail mount 141 forms part of the base 140 and slips into slots in the missile launch rail 103. Rail mount 141 may be separate pieces secured to the base and yielding the configuration as shown. In alternate embodiments the rail mounts may be a continuous piece with the base 140. Moving towards the rear 101, the base 140 attaches to the connector housing 130, which connects to a cap 120 on the housing's 130 rear 101 end. A top 104 and a bottom 105 of housing 130 have respective indents 132. Extending out of the cap 120 is a tube 110, which has a tube knob 111 comprising threads for connection to a cable assembly at its rear 101 most end.

Figure 1B:
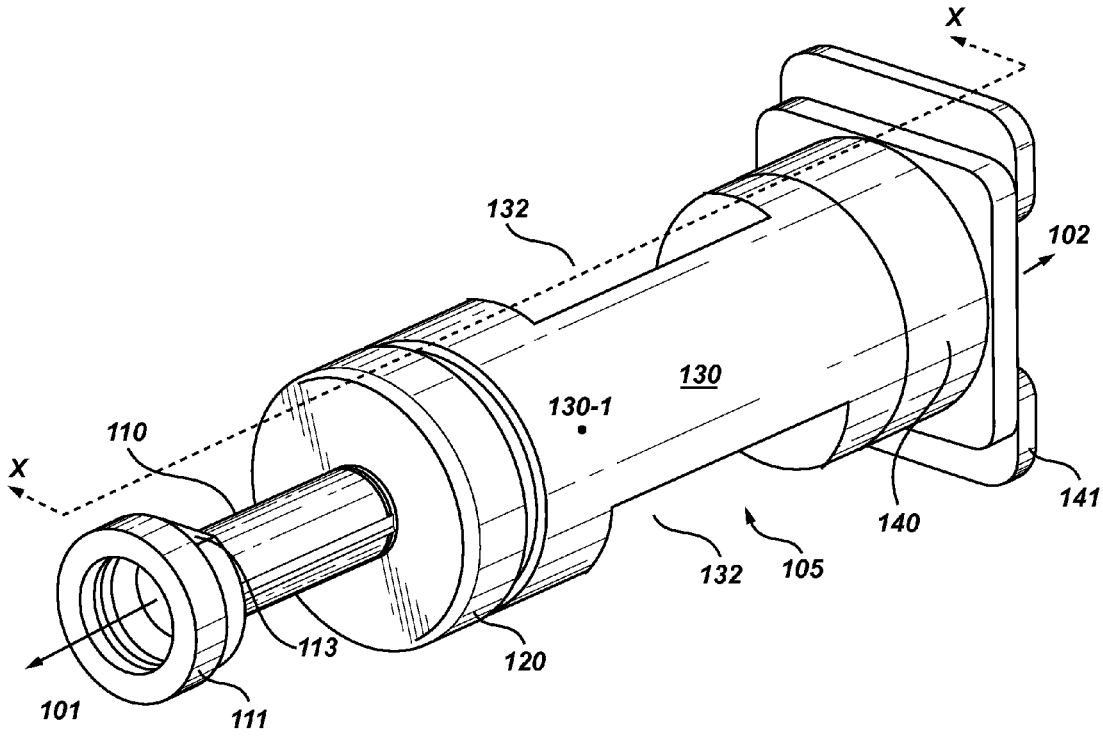
FIGS. 1B and 1C show a back and a front isometric view of a connector, respectively, in accordance with an embodiment of the present invention.

Turning to FIG. 1B, a back perspective of a connector, in accordance with an exemplary embodiment of the invention, shows the tube knob 111 in the foreground. As shown in FIG. 1B, the knob 111 and tube 110 are open in the center for the connector's electrical cables, cables not shown. Housing indents 132 in the housing 130 contribute to the user friendly design, providing, among other things, a tactile indicator of the connector's orientation. As shown in FIG. 1A, the indents 132 are parallel to respective rail mounts 141. Referring again to FIG. 1B, cap 120 is shown in the rear end 101 of the housing 130, while the base 140 attaches to the forward end 102 of the housing 130. Also indicated are a right side 130-1 of the connector housing. A flat edge 113 on the knob 111 provides a contact face for a wrench.

Figure 1C:
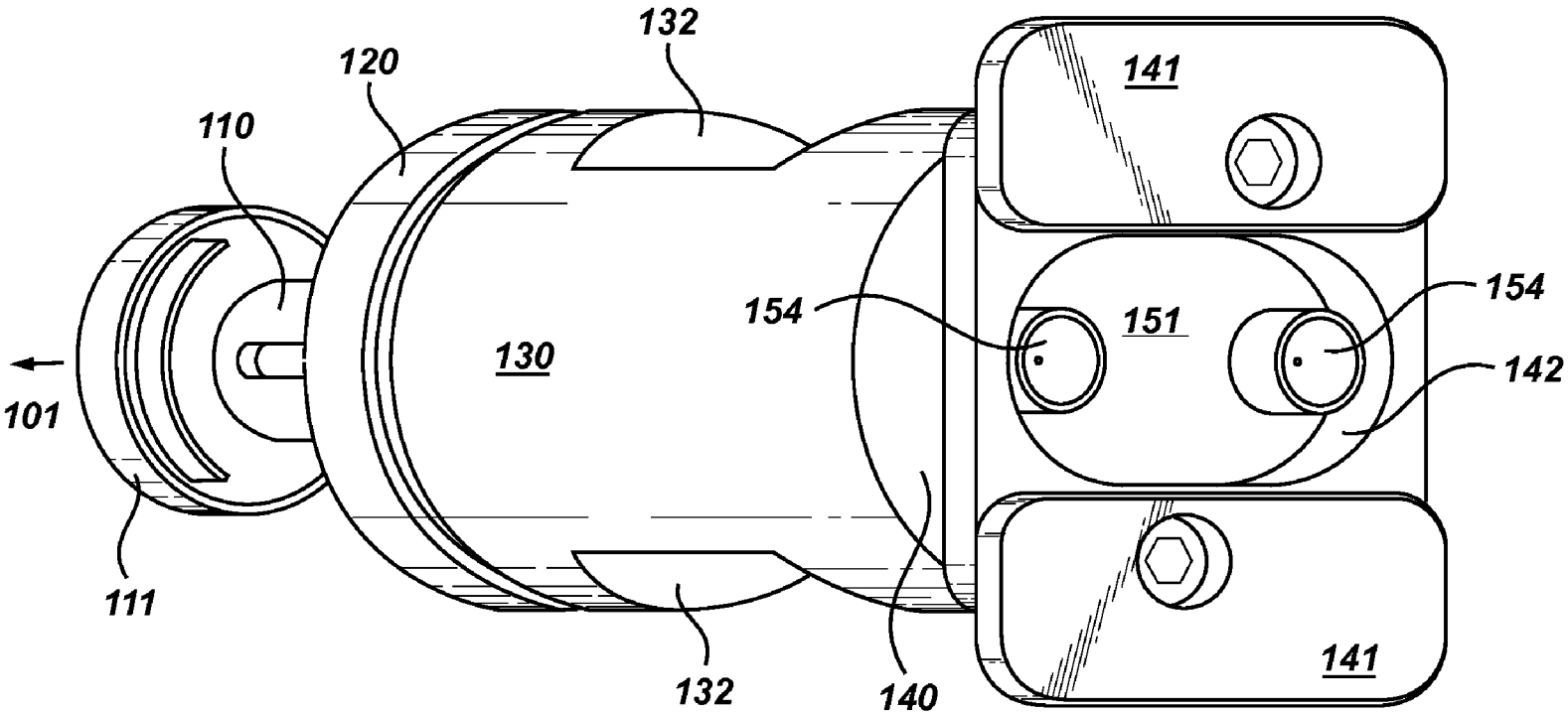

FIG. 1C shows a front isometric view of a connector in accordance with an exemplary embodiment of the present invention with an opening 142 in the base 140 in the foreground. Rail mounts 141 flank the top and bottom of the oblong opening 142. Seen through the opening 142 are the connector's electrical contacts 154 and an insulator 151. The opening 142 of the base and the axial cross section of the insulator 151 are oblong. Base 140 attaches to the connector housing 130. The top and bottom indents 132 in the housing 130 are shown. As in FIGS. 1A and 1B, the cap 120 attaches to the rear most end 101 of the housing, with the tube 110 extending out of the cap 120 and ending with the tube knob 111 in the background.

Figure 2:
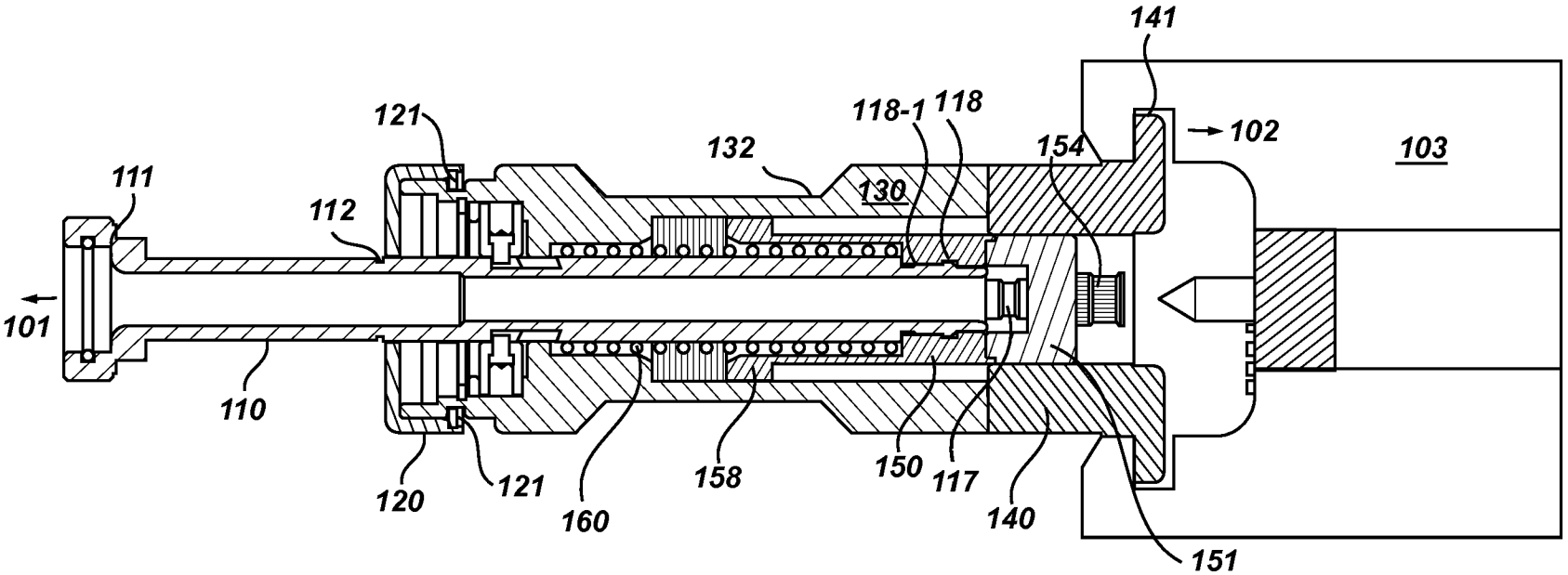
FIG. 2 shows a cross section of the connector shown in FIG. 1A the length of the connector, in accordance with an embodiment of the present invention.

FIG. 2 shows a center cross section of an exemplary connector in accordance with an embodiment of the present invention. The section is taken along the connector length 106 from top 104 to bottom 105, shown in FIG. 1A, with the same connector orientation as that shown in FIG. 1A. Referring again to FIG. 2, the rail mounts 141 at the forward end 102 of the connector are disposed in slots of the missile launch rail 103. Electrical contact 154 is housed within the base 140 of the connector and does not extend past the rail mounts 141. A contact pin, a striker point 103-1, of the missile launch rail 103 is shown aligned with an electrical contact 154 of the exemplary connector.

Housing 130 indents 132 are shown top and bottom in this cross sectional view. The tube 110 extends forward 102 from the knob 111 at the rear end 101 of the connector to the internal plunger 150. The tube 110 screws into the internal plunger 150, while annular groove 118-1 provides thread relief, where the threads are not shown. The electrical contacts 154 are secured to and move with the internal plunger 150. An insulator 151 is placed between the plunger 150 and the electrical contacts 154. The plunger 150, insulator 151, electrical contacts 154, and tube move as a unit within the housing 130. The connector is shown in the locked position, which is visually indicated to a user by the thin groove 112 being juxtaposition to the outer surface of the cap 120. The groove 112 almost circumscribes the tube 110 and is shown in more detail in FIG. 3A.

Figure 3A:
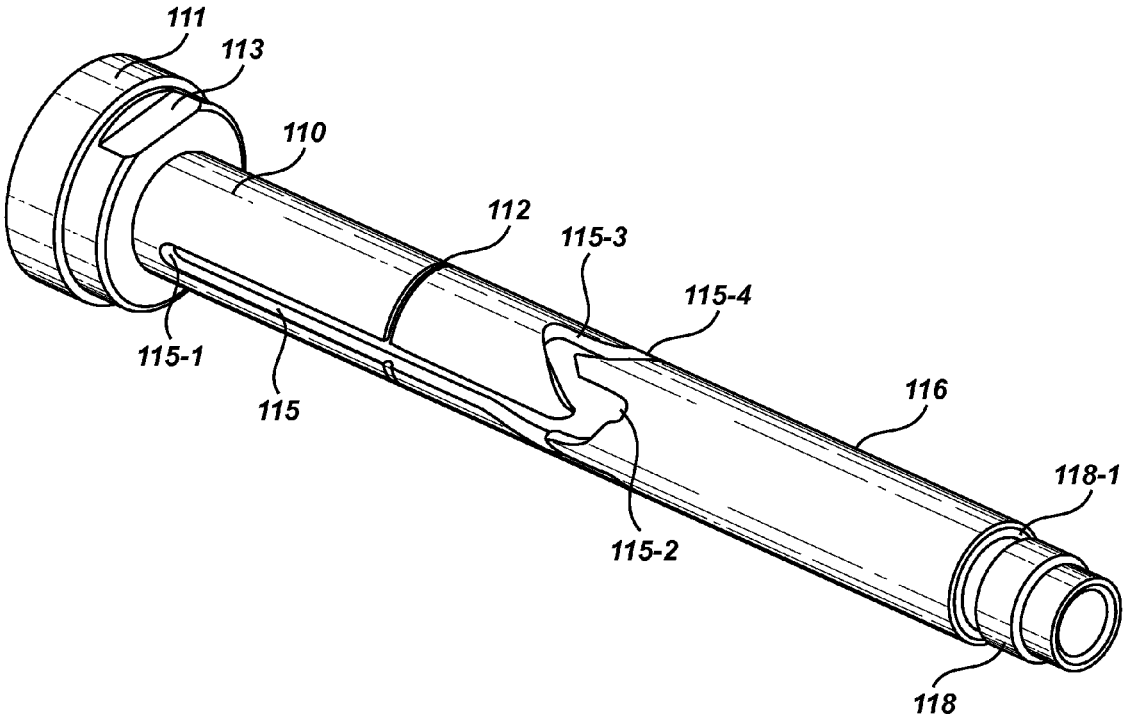
FIG. 3A shows a tube of a connector, in accordance with an exemplary embodiment of the present invention.
Figure 3B:
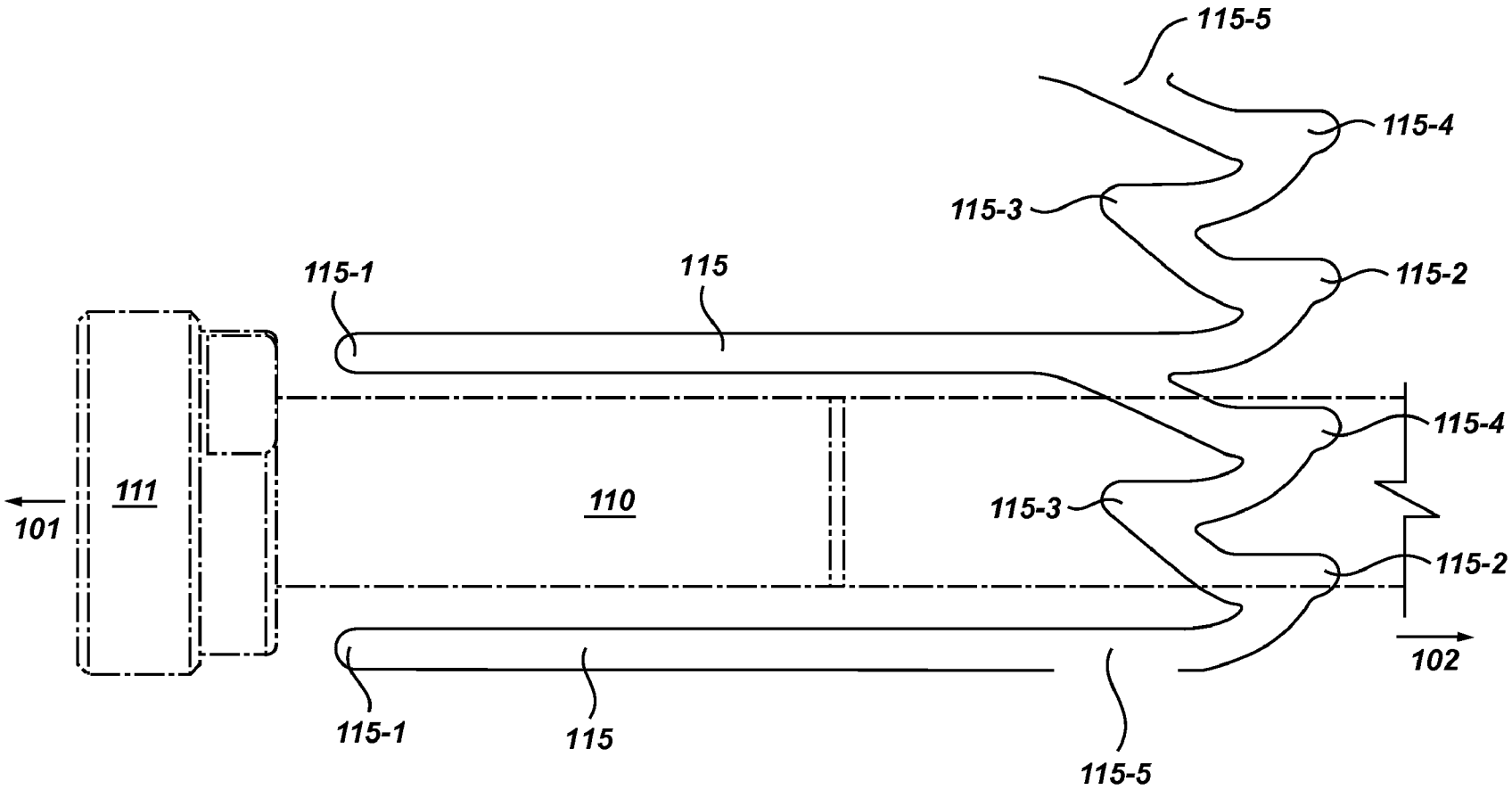
FIG. 3B shows a planar projection of the tube slots in accordance with an exemplary embodiment of the present invention.

FIG. 3A shows a tube 110 of a connector in greater detail, in accordance with an exemplary embodiment of the present invention. The tube has a groove track 115 towards the aft end 101 on its outer surface, while the forward portion 116 has a smooth outer surface. Five different locations along the track 115-1, 115-2, 115-3, 115-4, and 115-5 are identified and will be further described below with reference to FIGS. 3B, 4, 5, 6 and 7. Groove 112 is shown discontinued across the long part of the slot 115. FIG. 3B shows a planar projection of the tube track 115 in accordance with an exemplary embodiment of the present invention. The tube track 115 pattern repeats every 180 degrees. The track 115 comprises two long slots with ends 115-1 at the knob 111 end of the tube 110, separated by 180 degrees. Track locations 115-1 correspond to the plunger and electrical contacts being fully forward. From location 115-1 and moving forward 102, position 115-2 of the track corresponds to an interim locking position. Upwards of position 115-2 is the locked position 115-3. Moving up from position 115-3, position 115-4 corresponds to another interim position, the unlocking position. Moving up from unlocking position 115-4 and completing the track pattern, the position 115-5 opens into a forward 102 end of a track slot. The tube 110 attaches to internal plunger 150 towards the tube front 116 via threads, where plunger 150 is shown in FIG. 2. Threads, not shown, are cut at 118 just forward of an annular groove 118-1. The annular groove 118-1 provides thread relief.

Figure 4:
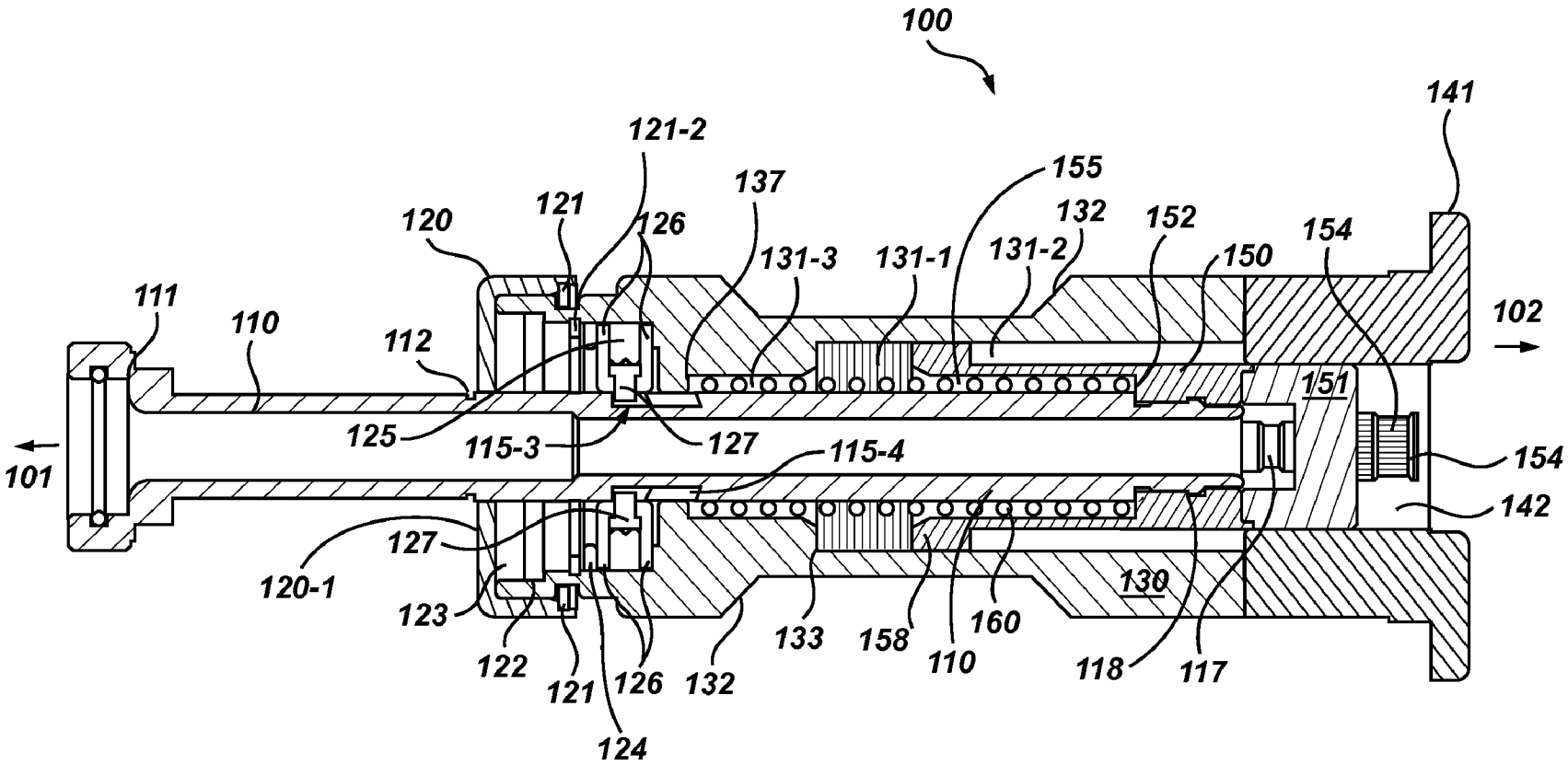
FIG. 4 shows a cross sectional view of a connector with the tube in the locked position, in accordance with an exemplary embodiment of the present invention.

FIG. 4 shows a cross section of an exemplary connector, in accordance with an embodiment of the present invention. The cross section is taken along line XX of FIG. 1B. FIG. 4 shows a cross sectional view of a connector with the tube 110 in the locked position, in accordance with an exemplary embodiment of the present invention. The groove 112 is shown just at the rear outer surface 120-1 of the cap 120 providing a visual indicator for the user that the electrical contacts 154 are withdrawn into the connector, inside opening 142. This juxtaposition of the groove 112 to the surface of the cap 120 indicates that the tube and the plunger assembly are in the locked position 115-3. The locked position 115-3 of the tube track is shown relative to the track 115 in FIGS. 3A and 3B. Referring again to FIG. 4, in this view an aft 101 end of electrical contact 154 can be seen 117. The locating pins 127 are affixed in an indexing ring 126 and are shown 180 degrees apart at corresponding 115-3 locked positions in the tube track, where just a portion of the tube track is visible. Set screws 125 hold the locating pins in the indexing cylinder 126. Just forward 102, just inside, of cap 120 is washer 123, and wiper 122. Retaining ring 121 affixes cap 120 to the housing 130. In alternate embodiments, other methods of affixing the cap 120 to the housing 130 are possible. Just aft 101 of the indexing ring 126 is washer 124, and aft again is retaining ring 121-2.

The forward end 102 of tube 110 affixes to plunger assembly 150. The tube 110 attaches to the plunger via threads and the two move forward 102 and aft 101 as a unit. Insulator 151 and contacts 154 are part of a plunger assembly and move with the plunger 150. At the plunger's 150 aft 101 end, it steps out forming a rim 158 to meet with an inner diameter of the housing 130. The outer circumference of the insulator 151 and the plunger 150, minus the step out, fit just inside the base opening 142. A compression spring 160 encircles the tube 110 and spans the distance from a spring ledge 152 in the plunger 150 to an aft spring ledge 137 in the housing 130. The locked position of FIG. 4 enables installation and removal of the connector 100 in the missile launch rail, not shown.

In the locked position of FIG. 4, there is a housing cavity 131-1 between the plunger rim 158 and ledge 133 of housing 130. In accordance with the exemplary embodiment of FIG. 4, the length wise span of cavity 131-1 is equal to the lengthwise distance between track positions 115-3 and 115-4. The radial cavity 131-3 between the outer surface of the tube 110 and the inner surface of the housing 130 rearwards 101 of ledge 133 is constant across each cross section in FIGS. 4-7.

Figure 5:
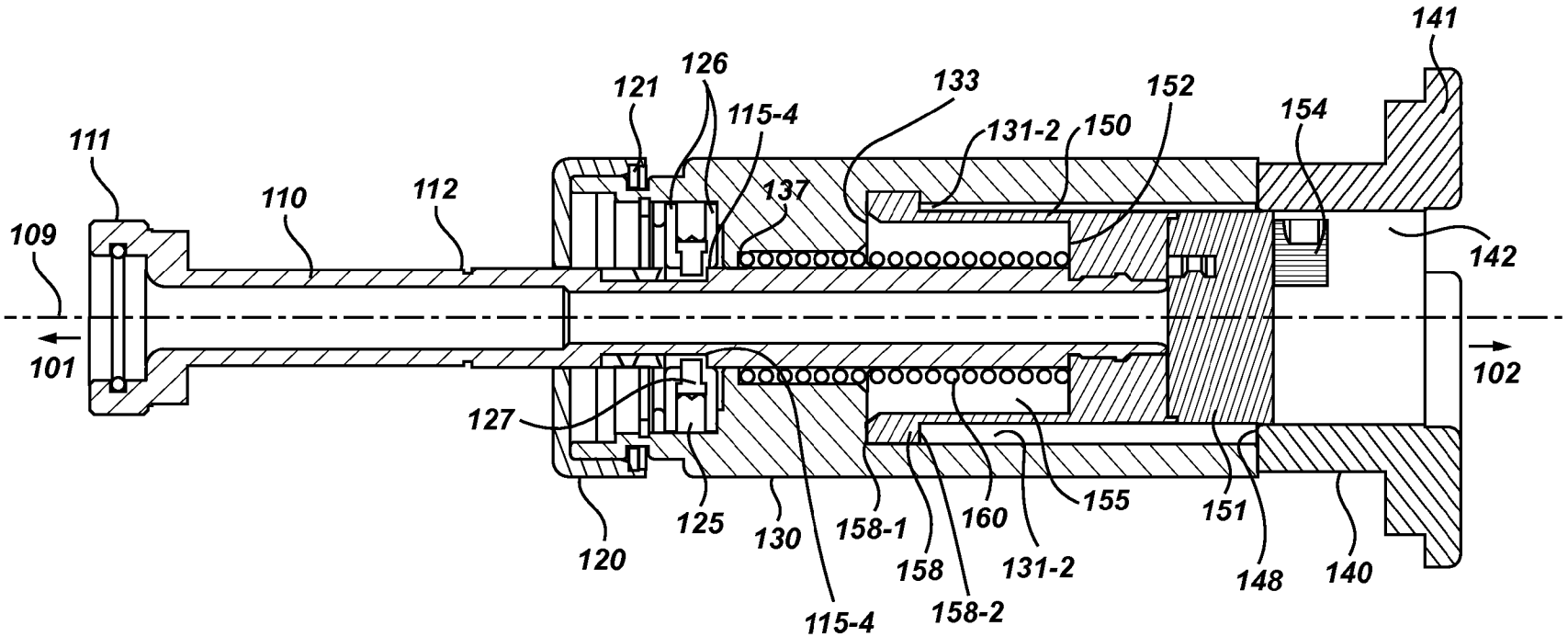
FIG. 5 shows a cross sectional view of a connector with the tube in an unlocking position, rotated 45 degrees from FIG. 4, in accordance with an exemplary embodiment of the present invention.

From the locked position of FIG. 4 the connector can move into the unlocking position of FIG. 5. Pulling aft 101 on the tube 110 will cause the connector to move into the unlocking position 115-4. Pulling aft on the tube 110 via the knob 111 allows the index ring or index cylinder 126 to rotate and locating pins 127 slide to the unlocking position of the track. The plunger and the connector translates into the unlocking 115-4 position as the index cylinder 126 rotates 45 degrees and the locating pins follow the track from positions 115-3 to 115-4, shown for example in FIG. 3B.

FIG. 5 shows a cross sectional view of a connector with the tube in an unlocking position, rotated 45 degrees clockwise from FIG. 4, in accordance with an exemplary embodiment of the present invention. To attain the unlocking position, the user pulls knob 111 rear ward 101. The locating pins 127 slide forward 102 in the track to the interim unlocking position of 115-4. The unlocking position 115-4 is also shown in FIG. 3B. The rear face 158-1 of the plunger rim 158 meets the backward stop 133 of the housing 130 as the tube 110 slips rearwards 101 extending further out of the cap 120 as compared to the locked position of FIG. 4. In reaching the interim unlocking position 115-4, compression spring 160 compresses further as compared to the locked state of FIG. 4. The plunger 150, insulator 151 and electrical contacts 154 are drawn fully backward, well rearwards of base opening 142. As seen from FIG. 5's cross section, neither the housing 130 nor the plunger 150 are symmetrical about the connector's center lengthwise axis 109. For example, the plunger cavity 155 of FIG. 5's unlocking position has a larger radial cross section as compared to the plunger cavity 155 of FIG. 4's locked position. The 45 degree rotation from FIG. 4 to FIG. 5 also yields a change in the outer wall thickness and profile of housing 130. The cavity 131-2 between the outer surface of the plunger 150 and the inner surface of the housing 130 decreases turning from FIG. 4 to FIG. 5. As shown between FIGS. 4 and 5, the plunger's inner cavity 155 is not symmetrical about the radius of the tube 110. In alternate embodiments, the plunger 150 may be radially symmetrical about its center line 109, shown in FIG. 5. The cross section of the plunger and insulator may be altered as needed or desired, for example, to fit into a recess of various missile launch rails.

From the unlocking position of FIG. 5, the connector can transition to its most forward position. A user can ease the backwards 101 resistance on the tube via the knob 111 and the index cylinder 126 will rotate another 45 degrees. The locating pin will move from the unlocking track position 115-4 to the opening to the long slot 115-5, shown in FIG. 3B. Once the locating pin is positioned in the forward 102 portion of the track slot 115, the tube 110 can move forward 102 under the force of the compressed spring 160. A user of an embodiment of the present invention can control the forward thrust and movement of the tube and electrical contacts, by holding back 101 on the knob 111.

Figure 6:
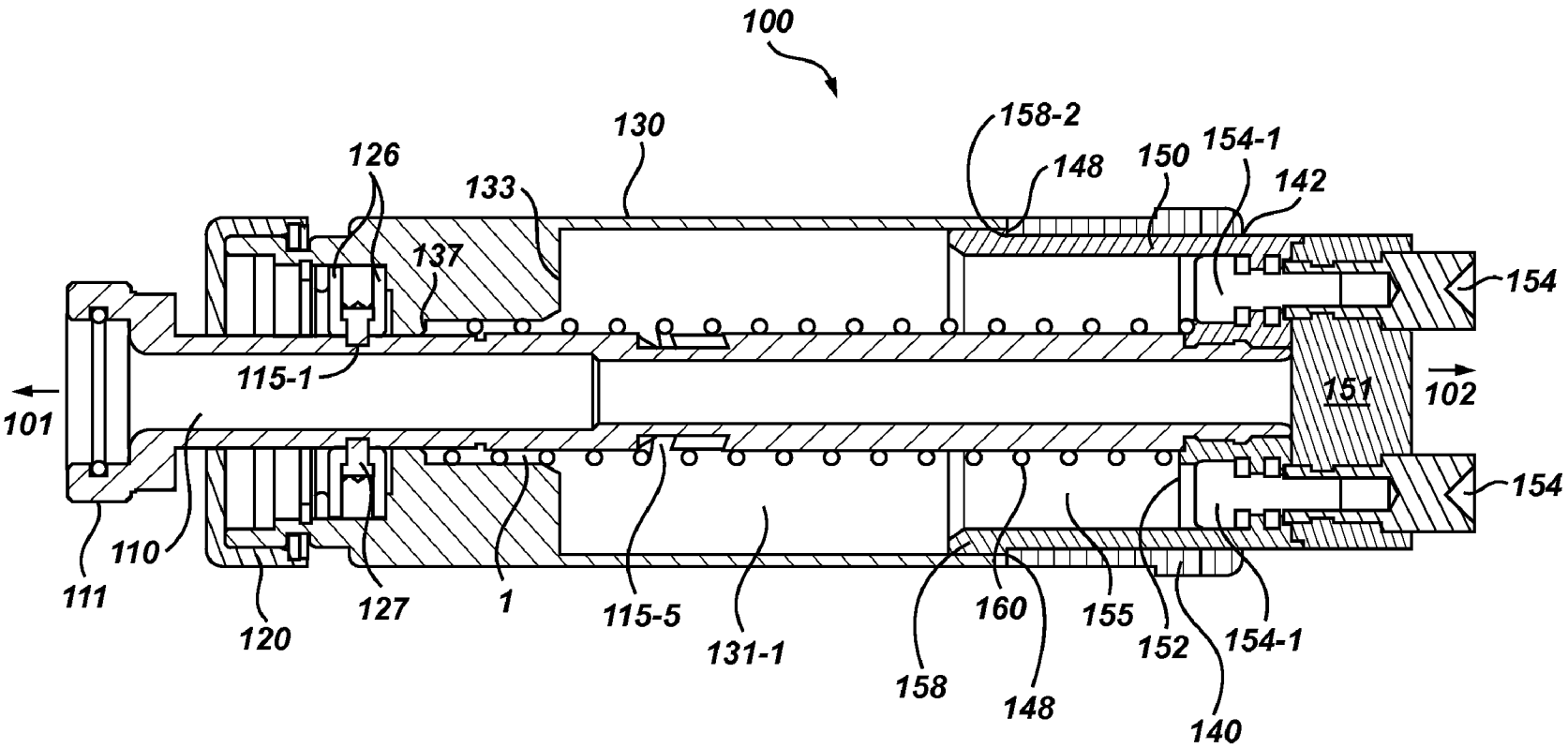
FIG. 6 shows a cross sectional view of a connector with the tube in the forward position, rotated 90 degrees from FIG. 4, in accordance with an exemplary embodiment of the present invention.

FIG. 6 shows a cross section of the connector rotated 45 degrees from the cross section in FIG. 5. The indexing cylinder 126 has rotated 45 degrees from FIG. 5 and the locating pins 127 are in the rear most slot position 115-1, slot not shown. The forward opening 115-5 of the long slot is shown in FIG. 6, while the long slot of the track 115 is particularly shown in FIGS. 3A and 3B. The knob is near the outer surface of the cap 120, while the electrical contacts 154 and insulator 151 are forward past the opening of the base 142. In accordance with the exemplary embodiment of FIG. 6, a portion of the plunger 150 is also forward 102 past the opening of the base 142. The spring 160 is expanded, lessening the compression of the spring. The forward face 158-2 of the plunger rim 158 catches on forward stop 148. Cavity 131-1 is at a maximum. In accordance with the present invention, the plunger displacement from backward 133 to forward stop 148 can span between 1 and 2 inches across exemplary embodiments. FIG. 6 shows a cross section 90 degrees from the locked position of FIG. 4, in turn, the rail mounts are not present in the cross section of FIG. 6. The cross section of FIG. 6 shows screws 154-1 holding the electrical contacts 154 in the insulator 151, in accordance with an exemplary embodiment.

From the fully forward position 115-1 of FIG. 6, a user can pull back on the knob 111 compressing the spring 160. Locating pins 127 slide forward 102 along the long slot of the track 115 and slip into interim unlocking position 115-2 as the index cylinder rotates another 45 degrees. FIG. 3B shows the relative positions of the track from full forward 115-1 to interim unlocking position 115-2 and FIG. 7 shows a cross section of the connector of FIG. 6 rotated another 45 degrees into the interim unlocking position 115-2.

Figure 7:
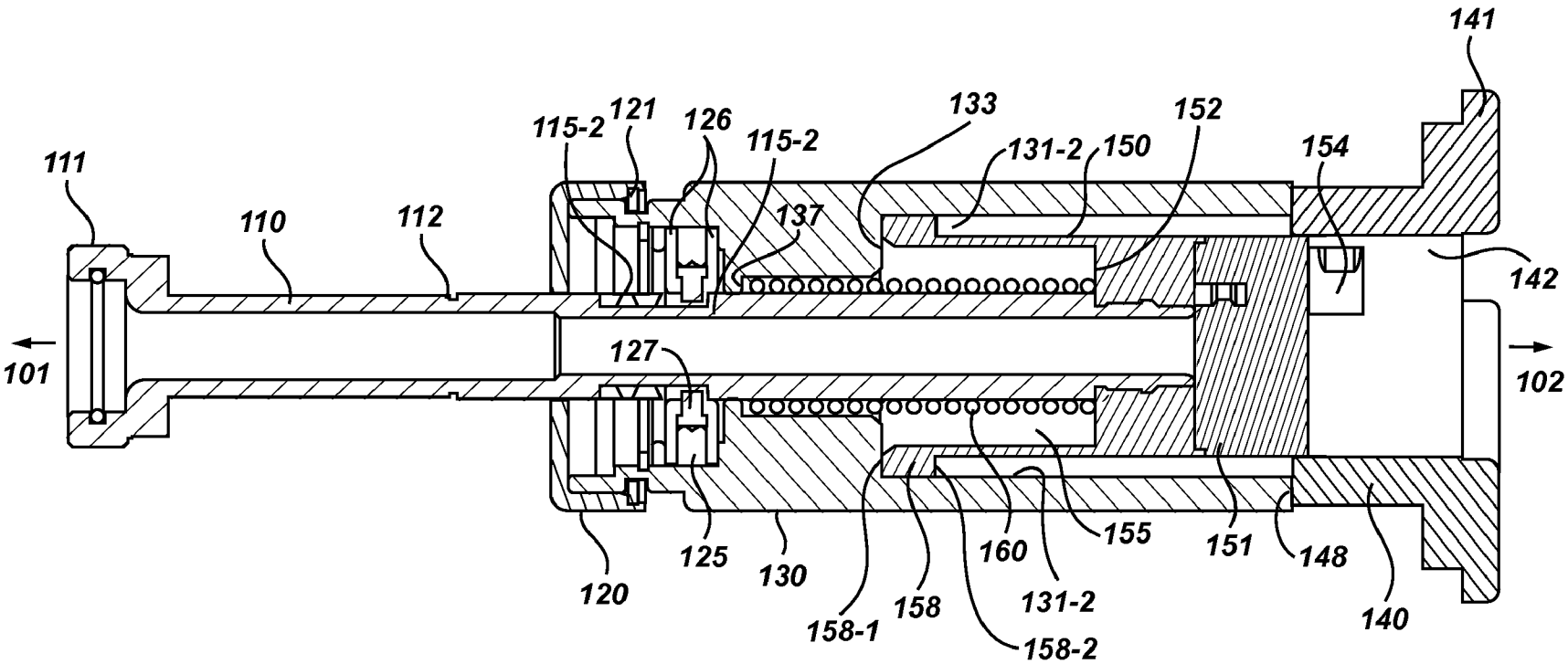
FIG. 7 shows a cross sectional view of a connector with the tube in a locking position, rotated 135 degrees from FIG. 4, in accordance with an exemplary embodiment of the present invention.

In FIG. 7 the aft edge of the plunger rim 158-1 rests against a backward stop 133 of the housing 130. Spring 160 is compressed between aft spring edge 137 and spring ledge 152. Contacts 154, where one contact is visible in the cross section of FIG. 7, are fully withdrawn into the base 140, well aft 101 of the opening 142. The groove 112 of tube 110 is pulled aft beyond the outer surface of the cap 120. From this interim locking position 115-2, the user can release knob 111 and the location pins 127 will move in the track 115, shown in FIG. 3B, as the indexing cylinder rotates another 45 degrees to return to the locked position 115-3, shown in FIG. 4. FIG. 7 shows a cross sectional view of a connector with the tube in an interim locking position, rotated 135 degrees from FIG. 4 in accordance with an exemplary embodiment of the present invention.

In accordance with alternate embodiments, the number of indexing pins and corresponding repeated patterns in a given track can be increased as needed or desired. In addition, the track configuration can also vary to provide, for example, additional locked positions or interim positions, or both.

The total possible excursion of the plunger assembly can be increased or decreased by commensurate alterations in the slot 115-1 length of the track 115 in alternate embodiments. Corresponding changes in the interior housing configuration to accommodate increased or decreased displacement of the plunger, insulator, and electrical contacts can afford the desired variation in displacement in such alternate embodiments. With a change in contact displacement forward and aft, a change in spring size may be desired to increase or decrease the force on the plunger when moving forward.

The indent portion 132 of the housing 130, shown for example in FIG. 1C, is exemplary and alternate embodiments can vary the exterior surface of the housing 130 as needed or desired for use and efficiency. A spring with a higher constant can be used to provide increased forward drive on the plunger in alternate embodiments. In accordance with an exemplary embodiment, a spring 160 having a spring rate of 5.4 pounds per inch and an initial length of 4.0 inches provides the driving force for a one and four-tenths inch displacement of the plunger assembly 150 relative to the locked position 115-3. The inner diameter of cavity 131-2 and the inner diameter of the plunger cavity 155 can be increased to accommodate a larger external diameter of spring 160 and a larger outer diameter of the tube 110 if desired in alternate embodiments. In accordance with an exemplary embodiment, 302 stainless steel may be the used as the spring material.

A top flat edge 113 of knob 111 is shown FIG. 3B. A knob 111, in accordance with an exemplary embodiment of the present invention, may include parallel flat edges for mating with a wrench. Alternate configurations may be used across alternate embodiments. In still alternate embodiments, the cross section shape or size of the plunger 150 and opening in the base plate 142 can vary as needed for compatibility with, for example, alternate missile launch rail designs 103. The number and placement of electrical contacts 154 can similarly be varied across alternate embodiments. Corresponding changes in housing inner diameter to accommodate changes in plunger cross section can be made in such alternate embodiments.

Figures 8A, 8B:
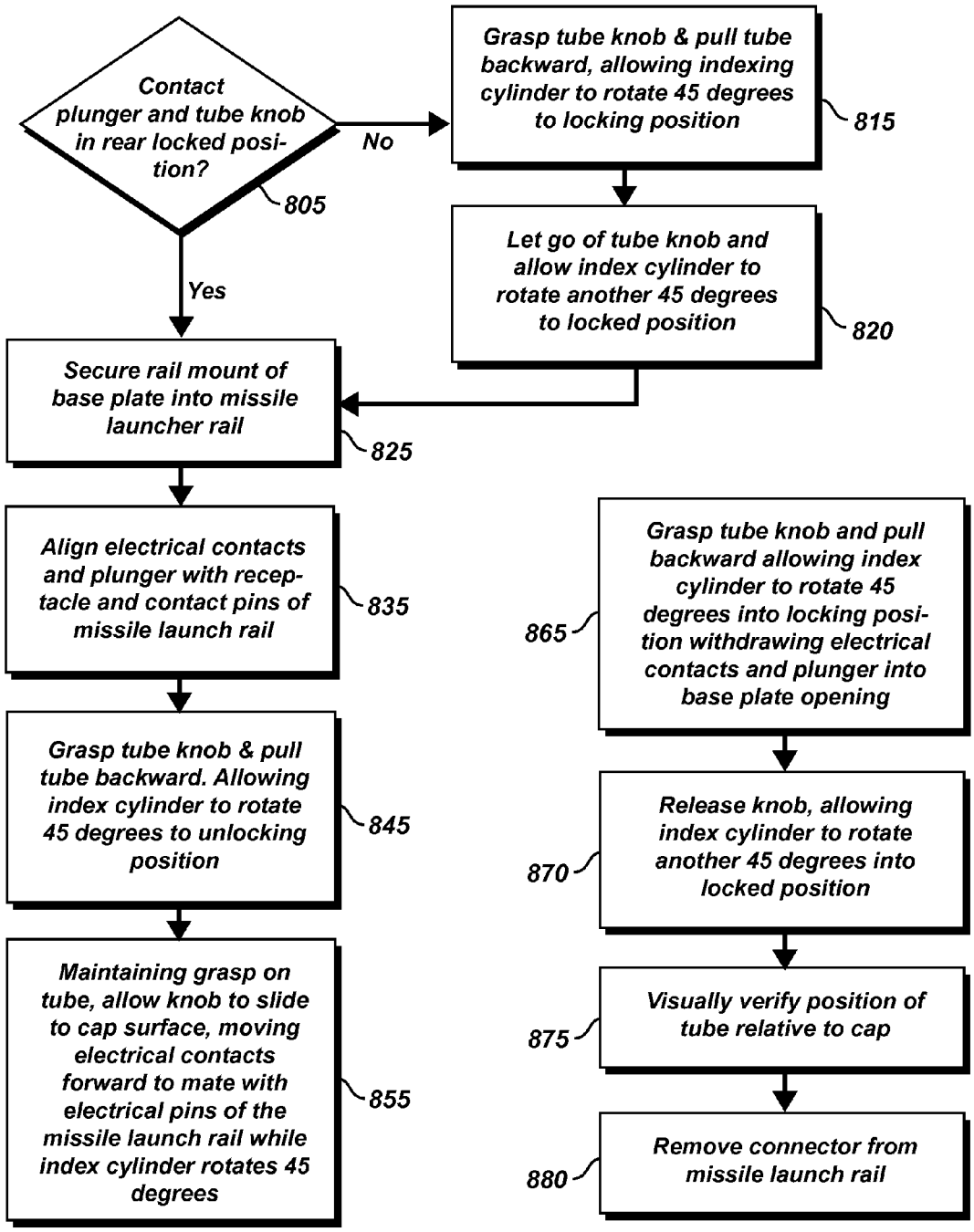
FIGS. 8A and 8B show a method of connecting a connector to and disconnecting a connector from a missile launch rail, respectively, in accordance with an exemplary embodiment of the present invention.

FIGS. 8A and 8B show a method of connecting a connector to and disconnecting a connector from a missile launch rail, respectively, in accordance with an exemplary embodiment of the present invention. Initially, a user can verify that the contact plunger and tube knob are in the rear locked position 805. This may be done by visually verifying a position of the electrical contacts 154 as rearwards 101 from opening 142, as shown for example in FIG. 4. The user can also verify that the connector is in its locked position by noting the groove 112 in close proximity to the rear outer surface of the cap 120-1, also shown in FIG. 4. Referring again to FIG. 8A, if the connector is not in the locked position, then an exemplary connector embodiment would be in the full forward position, 115-1, shown for example in FIG. 3B and FIG. 6, and the user can grasp the knob and pull the tube backward 815, allowing the indexing cylinder to rotate 45 degrees to an interim locking position 815.

Then, letting go of the knob allows the index cylinder to rotate another 45 degrees to the locked position 820. The interim locking position 115-2 and the locked position 115-3 are shown, for example, in FIGS. 7 and 4, respectively. The unlocking and locked positions can be confirmed by the user via visual inspection of the groove's 112 relative position to surface 120-1 as described in reference to FIGS. 7 and 4 above. Once the locked position is verified, a user can secure the connector rail mount of the base plate into the missile launch rail 825. A connector 100, in accordance with an exemplary embodiment of the present invention, is shown secured to a missile launch rail 103 in FIGS. 1A and 2.

Referring again to FIG. 8A, a method of connecting a connector to a missile launch rail continues with aligning the electrical contacts and plunger of the connector with the receptacle and contact pins of the missile launch rail 835. Then, grasping the tube knob and pulling the tube backward, allows the index cylinder to rotate 45 degrees to an unlocking position 845. From the unlocking position, the user maintains the grasp on the tube knob, allowing the knob to slide forward towards the cap surface, the index cylinder rotates another 45 degrees, and the electrical contacts move forward to mate with the contact pins of the missile launch rail. Referring to FIGS. 6 and 3A, the index pins 127 slide into position 115-1 as the tube moves forward 102.

FIG. 8B shows an exemplary method of disconnecting and removing an electrical connector from a missile launch rail, in accordance with an embodiment of the present invention. A user may grasp the tube knob and pull backward, allowing the index cylinder to rotate 45 degrees into a locking position, which withdraws the electrical contacts and the plunger into a base plate opening 865. Releasing the knob, allows the index cylinder to rotate another 45 degrees into a locked position 870. Next the user may visually verify the position of the tube relative to the cap to confirm the connector is in a locked position with the electrical contacts retracted into the base 875. Once the retracted position is confirmed, the user may remove the connector from the missile launch rail. 880.

The configuration of the rail mount of the connector base may also be varied in alternate embodiments to permit secure mounting of the connector in alternate missile launch rails.

Visual verification of electrical contact to contact pin mating may not be possible in field applications with, for example, the contact pins being recessed in narrow opening. In accordance with embodiments of the present invention, the user can verify the position of the tube knob relative to the cap, which reflects the forward position of the electrical contacts. Additionally, a groove on a rearward tube provides a visual indicator to a user of a connector in a locked position or in an interim position.

The potential energy needed to carry the electrical contacts and electric cables from a disengaged position to an axially forward position of electrical contact may be significant in field applications. While conventional connectors may provide the desired forward translation from a disengaged position, the associated high impact forces are undesirable. Conventional connectors lack a means for controlling or limiting initial impact forces of connector electrical contacts on contact pins. This impact may compromise respective contact and pin integrities with repeated application. Periodic testing and resulting conventional impact may also diminish reliability and useful life of the contacts and the pins. The present invention provides a mechanism for controlling and minimizing the impact forces of a connector's electrical contacts on the contact pins of a missile launch rail. An exemplary embodiment of the present invention provides the needed energy to displace the electrical contacts forward, while affording control of the connector's electrical contacts movement to the user.

A connector, in accordance with an exemplary embodiment of the present invention, is ergonomically friendly to use. A user can provide resistance to contacts moving forward under compressed spring energy by providing resistance, backward pull, on a rear facing knob. In alternate embodiments, the knob on the tube end may be a handle or a knob of alternate shape.

The user can use a hand grip to actuate tube movement across the locked to forward unlocked positions, including interim unlocking positions. This manual function may reduce hand fatigue when repeated use of the connector is needed as compared to repeated use of a conventional connector. In addition, the initial release of the connector from its locked position is user friendly. Since a user already has a grip on the knob when releasing the connector from its locked position to an interim unlocking position, no change in hand position is needed to apply resistive force as the tube, plunger, and electrical contacts begin to move forward from the interim unlocking position.

Embodiments of the present invention provide a method of limiting the initial contact forces, while also providing ease of use in field applications.

An exemplary embodiment of the present invention, shown for example in FIG. 2, has been successfully connected to and disconnected from two different conventional missile launch rails compatible with, at least, F-16 aircraft and AIM-9 missiles. Both rails have retractable striker points, contact pins, for the missile. Connection to these striker points with the connector's electrical contacts is desired and needed at these various retracting positions. The connector mounted in both rails successfully. Further, once the connector was unlocked, its electrical contacts were able to initially engage the striker and maintain contact across the various retracting positions. The connector was user friendly and control of the electrical contacts' impact on the striker points was afforded to the user. Upon completion of the connection test, the connector was returned to its locked position and removed from the launch rail.

Embodiments of the present invention are relatively easy to use in connecting to and testing of circuitry for a missile launch rail. Sufficient energy to translate a plunger and electrical contacts forward into a recess of a missile launch rail is provided via a compression spring. Release of electrical contacts from their spring loaded disengaged and locked position is user friendly. The present invention enables control of the impact force across electrical contacts and contact pins to prolong the working life of the connector and missile launch rail without the need for replacing electrical contacts and contact pins.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended claims and drawings.

What is claimed is:

1. A spring loaded electrical connector for testing a missile launch rail, the connector comprising:

a base comprising:

a rail mount;

a forward end; and an opening in the forward end;

a housing, having a first end and a second end, wherein the first end attaches to the base;

a cap attached to the second end of the housing and comprising a cap opening;

an internal plunger housed in the housing;

an insulator attached to the plunger on a plunger forward end;

at least one electrical contact attached to the insulator and facing the opening in the forward end of the base;

a tube having a first tube end and a second tube end, wherein the first tube end attaches to a plunger rearward end and is housed in the housing, and wherein the second tube end extends rearwards out of the opening in the cap;

a knob, attached to the second tube end;

a locating track cut into an outer surface of the tube;

an indexing cylinder, circumscribing the tube and housed in the housing;

two locating pins, attached to the indexing cylinder and riding in the locating track;

a compression spring, circumscribing the tube, housed in the housing, and extending from an aft spring ledge to a forward spring ledge; and wherein the compression spring compresses as the plunger, the insulator, and the at least one electrical contact move rearward and decompresses as the plunger, the insulator, and the at least one electrical contact move forward.

2. The connector according to claim 1, wherein:

the tube moves forward when the plunger, the insulator, and the electrical contacts move forward.

3. The connector according to claim 1, wherein:

the internal plunger has an oblong axial cross section.

4. The connector according to claim 1, wherein:

the track is continuous and circumscribes the outer surface of the tube.

5. The connector according to claim 4, further comprising:

two long parallel slots 180 degrees apart in the track.

6. The connector according to claim 5, wherein:

the track comprises an interim locking position and an interim unlocking position.

7. The connector according to claim 4, wherein:

the track comprises a locked position.

8. The connector according to claim 1, further comprising:

two set screws respectively securing the two locating pins in the indexing cylinder separated by 180 degrees.

9. The connector according to claim 1, further comprising:

a flat edge on the knob.

10. The connector according to claim 7, further comprising:

a groove in the outer surface of the tube, configured to be juxtaposition an outer cap surface when the tube is in the locked position.

11. The connector according to claim 1, wherein:

the spring has a spring rate between 5.0 and 6.0 pounds per inch and an initial length between 3.5 and 4.5 inches.

12. The connector according to claim 5, wherein:

the two parallel slots have a length of at least 1.0 inch and the plunger and the electrical contacts can translate forward greater than 1.0 inch from a locked position.

13. The connector according to claim 1, further comprising:

two indents in the housing at a top and a bottom, respectively, providing a user grip and a tactile indicator of connector orientation.

14. The connector according to claim 1, further comprising:

an oblong axial cross section of the plunger and the insulator.

* * * * *